United States Patent [19]

Goodrich

[11] Patent Number: 4,611,623

[45] Date of Patent: Sep. 16, 1986

[54] LIQUID LEVEL INDICATOR AND VALVE

[75] Inventor: Roy G. Goodrich, Baton Rouge, La.

[73] Assignee: Louisiana State University and Mechanical College, Baton Rouge, La.

[21] Appl. No.: 749,432

[22] Filed: Jun. 27, 1985

[51] Int. Cl.[4] ..... F17C 7/02

[52] U.S. Cl. ..... 137/210; 62/55; 137/386

[58] Field of Search ..... 137/210, 209, 386; 62/55

[56] References Cited

U.S. PATENT DOCUMENTS

| | | | |
|---|---|---|---|
| 2,570,451 | 10/1951 | Hottenroth | 137/386 X |
| 2,756,765 | 7/1956 | Agule | 137/386 |
| 3,605,424 | 9/1971 | Paine | 137/386 X |
| 3,681,546 | 8/1972 | Coin | 137/386 X |

*Primary Examiner*—Alan Cohan

*Attorney, Agent, or Firm*—Edgar E. Spielman, Jr.

[57] ABSTRACT

This invention relates to a device for monitoring a liquid level in a first vessel and for effecting the transfer of liquid to the first vessel from a second vessel upon the liquid level in the first vessel reaching a predetermined minimum point. The device comprises a pressure sensitive appliance which is in contact with a gas in a first and in a second chamber. The pressure sensitive appliance is movable between a first position and a second position. The second position is towards the first chamber and occurs when the pressure in the first chamber is lower than the pressure in the second chamber. The first chamber is vented to an ambient atmosphere. A conduit is also provided which is in gas communication with the first chamber and with the interior of the second vessel. A valve is associated with the pressure sensitive appliance and is used to alternately seal off and leave open the gas communication between the first chamber and the second vessel upon the movement of the pressure sensitive appliance to the positions. The second chamber is in gas communication with an elongated hollow stem which is closed at its other end. This stem has a portion which extends into the interior of the first vessel to a point which is below the predetermined minimum liquid level and a portion, exterior of the first vessel, which is in contact with the ambient atmosphere. Insulation is utilized to insulate a lower portion of the stem within the first vessel.

21 Claims, 4 Drawing Figures

LIQUID LEVEL INDICATOR AND VALVE

LICENSE RIGHTS

The U.S. Government has a paid-up license in this invention and the right in limited circumstances to require the patent owner to license others on reasonable terms as provided for by the terms of Grant No. DMR-82-06116 awarded by the National Science Foundation.

BACKGROUND OF THE INVENTION

Generally, this invention relates to a device for sensing a predetermined liquid level in a first vessel and for the concomitant actuation of a valve to effect transfer of liquid to the first vessel from a second vessel.

The maintenance of a selected liquid level in a storage vessel is critical when the vessel is used to store materials which will deteriorate when exposed to ambient temperatures. Such materials include: biological substances, e.g. semen, viscera and epidermal tissue; x-ray and gamma-ray detectors, infrared detectors and thermal shielding for a variety of superconducting equipment. Such storage generally entails containering the material an submerging the container in a cryogenic liquid such as liquid nitrogen. Usually, the vessel used is an unpressurized Dewar type vessel which allows for venting of vapor coming from the cyrogenic liquid. As the vaporization continues over time, the liquid level will fall and, if the liquid is not replenished, its level will expose greater and greater portions of the containers. Such exposure will ultimately submit the containered materials to ruinous temperatures. To insure the proper liquid level in the storage vessel, the prior art has provided for monitoring of the storage vessel liquid level and for a reservoir vessel to be connected to the storage vessel by way of a valved transfer line. Monitoring of the liquid level in the storage vessel can be made by visual observation or by the use of mechanical or electrical liquid level sensors in the storage vessel. If the liquid level indicates that replenishment from the reservoir vessel is needed, the transfer line valve is set to the "ON" position and the cryogenic liquid is transferred from the reservoir vessel to the storage vessel by conventional means, such as by providing a head pressure over the liquid in the reservoir vessel, pumping or gravity flow. Setting the valve can be effected manually or can be electrical activated in response to the liquid level sensors. In either case, the reliability of liquid level maintenance is not high especially if the storage period is long, say from 6 months to 10 years. Visual monitoring requires personnel to be on duty at all times which may not always be possible. The use of liquid level sensors and electrically activated valves depends upon a line or battery source for the electricity. Line electricity is notorious for interruptions while battery supplied electricity is dependent upon the integrity and the discharge state of the battery.

Therefore, it is an object of this invention to provide a highly reliable, essentially labor-free, non electrical, liquid level monitoring and valving device for effecting the transfer of liquid to a first vessel from a second vessel so as to maintain a predetermined minimum liquid level in the first vessel.

THE INVENTION

A passive device for the monitoring and maintenance of a liquid level in a vessel is provided by the following described invention.

The device of this invention is for use with a first liquid containing vessel, i.e. the vessel which is used for storage, temperature maintenance, etc., and at least one other liquid containing vessel which will serve as the reservoir vessel from which the first vessel may be replenished. (For the sake of simplicity, the at least one other liquid containing vessel will be referred to hereinafter as the second vessel.) The liquid transfer from the second vessel to the first vessel is through a conduit which is accessed to the interiors of both vessels. The second vessel will contain, and the first vessel may contain, a vapor evolving liquid. The evolution of the vapor can be due to the liquid being at or near its boiling point or can be due to chemical reaction.

The determination of when the liquid transfer is to occur and the provision for powering the transfer is effected by the device of this invention. The subject device features a pressure sensitive appliance which is in contact with a gas in a first and a second chamber. The gases in the chambers are isolated from one another. The pressure sensitive appliance is movable towards the first chamber to achieve the valving function, as hereinafter described, when the gaseous pressure in the second chamber is greater by a certain amount than that in the first chamber. The pressure sensitive appliance can conveniently be a diaphragm, bellows or a piston/cylinder arrangement. Other types of pressure sensitive appliances can be used so long as they can achieve the necessary movement for accomplishment of the valving function. The most preferred of these appliances, due to its cost and simplicity, is a resilient diaphragm. The diaphragm can be of any elastic material which is not adversely affected by the temperatures, pressures and substances that it will encounter in use. For example, the diaphragm can be of neoprene, polytetrafluoroethylene, rubber, and the like.

The first chamber is vented so as to be in gas communication with an ambient atmosphere which is generally air at room temperature and at atmospheric pressure. The first chamber is also in gas communication, by way of a conduit, with the interior of the second vessel thereby providing communication to the first chamber of vapors produced in the second vessel. The evolution of vapors in the second vessel produces a pressure therein greater than that of the ambient atmosphere.

The valving mechanism provided by the device of this invention is actuated to the opened or closed position by the certain amount of movement towards the first chamber by the pressure sensitive appliance. The valve, when closed, closes off the gaseous communication between the first chamber and the second vessel. It is preferred that this closing off occur in the proximity of the point of gas communication between the conduit and the first chamber. The movement of the pressure sensitive appliance can actuate the valve mechanism in a direct or in an indirect manner. In the direct manner, the valve's movement for actuation substantially mimics the pressure sensitive appliance's movement. In the indirect manner, the pressure sensitive appliance's movement is magnified, diminished or converted by intervening mechanisms between the valve and the appliance to give the valve the desired actuating movement. The direct manner is usually preferred for its simplicity and reliability.

Actuation in the direct manner is exemplified by having the valve attached to the pressure sensitive appliance so that the valve is within the first chamber and in proximity to the point of the gaseous communication between the conduit and the first chamber. Such proximal location is specified so that movement of the pressure sensitive appliance brings the valve to an abutting location so that the conduit mouth is isolated from the first chamber or is stoppered. Conduit isolation from the first chamber can be accomplished by the valve having a sealing portion, such as an O ring, which is moved to a gas tight fit with a surface, such as that provided by a portion of the first chamber's interior or exterior wall, and to a location which circumvents the conduit mouth. Stoppering of the conduit mouth can be effected by providing a valve having a projection similar to a needle valve which is seated, by movement of the pressure sensitive appliance, into a valve seat defining the conduit mouth. Other valve configurations known to those skilled in the art can be used to achieve the direct manner valve actuation.

The second chamber is in gas communication with an elongated hollow stem. The stem is sealed off at its distal end. The distal end and an adjacent portion of the stem extend into the first vessel so that the distal end will be significantly below the predetermined minimum liquid level in the first vessel, say from about 1 inch to about 6 inches for a typical 25 liter Dewar vessel. At least a part of the remainder of the stem portion in the vessel will be exposed to liquid levels above the minimum liquid level. The stem is hollow as before noted and can be of a cylindrical configuration which is preferred due to ready availability. The stem should have an inside diameter which, in consideration of the type of pressure sensitive appliance and valve used, the total stem length, the liquid in the vessel, the ambient atmosphere temperature and the fluid in the stem, will provide the optimum stem volume for obtaining the required movement of the the pressure sensitive appliance. Due to the many combinations that can be encountered, determination of the stem inside diameter is best determined empirically. It has been found that when: the pressure sensitive appliance is a diaphragm and the valve is a circumventing O ring, as is shown for the device illustrated in the accompanying drawings; the liquid is liquid nitrogen; the stem fluid is air; and the stem has a total length of 12 inches, that the inside stem diameter is preferably within the range of from about $\frac{1}{4}$ to about $\frac{3}{8}$ inches.

The stem can be of pyrex glass, stainless steel, constantan, inconel, monel, nylon, polytetrafluoroethylene and the like, so long as the stem material has low thermal conductivity, is not adversely affected by expected temperatures and pressures and is not reactive under expected conditions with either the liquid in the first vessel or the fluid in the stem.

The distal end and a contiguous portion of the stem, which extends to the proximity of the point marking the minimum liquid level in the first vessel, are insulated. Insulation can be achieved with insulating material or by a vacuum chamber. In any event, the insulation and the vacuum chamber should be liquid tight to the insulated portion of the stem. Suitable insulating materials are: rigid foams, such as, foamed polystyrene, polyurethane, foamed glass, foamed silica, foamed epoxy resin; contained powders such as perlite, expanded silicon oxide, calcium silicate and diatomaceous earth; and sealed corkboard or balsa wood.

The fluid in the stem can be any fluid which provides: (1) when the liquid in the first vessel is at or below the insulated portion of the stem, a pressure in the second chamber to allow the pressure sensitive appliance to move so that the valve will close off the gas communication between the first chamber and the conduit; and (2) when the liquid in the first vessel is in contact with a certain portion of the uninsulated part of the stem within the first vessel, a pressure in the second chamber to allow the pressure sensitive appliance to move so that the valve is not closing off the gas communication between the first chamber and the conduit. The selection of a fluid will be dependent, at least in part, upon the temperature of the liquid in the first vessel, the ambient atmospheric temperature and pressure, the diameter of the stem and the stem length between the second chamber and the outside of the first vessel. (The temperature of the ambient atmosphere and the length of exterior stem will be determinative of the amount of heat or cooling available to the fluid in the stem, such heat or cooling being used to raise or lower, respectively, the fluid pressure when the liquid in the first vessel is above the insulated portion of the stem). The selection of the best fluid for any particular use and device is of necessity an empirical one, the main requirement being that the fluid used provides a sufficient difference between its pressure at the cooled condition and its pressure at the heated condition so as to give sufficient valve operating motion to the pressure sensitive appliance. A preferred choice of available candidate fluids are those that are a liquid when the fluid is in the cooled condition and a gas when the fluid is in the heated condition. Fluids which can be of use when the liquid in the first vessel is cryogenic are; nitrogen, air, oxygen, hydrogen, carbon monoxide, argon, methane and the like. Exemplary of suitable fluids for use when the first vessel liquid is at a temperature higher than the ambient atmospheric temperature are isopropyl alcohol, ethyl alcohol, heptane, etc.

In operation the device of this invention is the paragon of simplicity. For cyrogenic liquids, before installing the device, the second chamber and stem are filled with the selected fluid at a pressure sufficient to move the pressure sensitive appliance towards the first chamber so that the valve will close off the gas communication between the conduit coming from second vessel to the first chamber. The device is then located so that the desired portion of the stem is within the first vessel and so that the lowermost extent of the stem insulation is adjacent the point marking the minimum liquid level selected. Since the valve is closed, i.e. in the OFF position, the vapors evolving from the liquid in the second vessel are not free to vent via the conduit and to the vent in the first chamber. Thus a head pressure over the liquid in the second vessel begins to build. The first vessel, however, is vented to the ambient atmosphere and therefore the pressure difference between the two vessels provides the driving force to transfer the liquid from the high pressured second vessel to the first vessel by way of the liquid transfer conduit located between the two vessels. As the liquid from the second vessel rises, the liquid level in the first vessel will first be in contact with the insulated stem portion. Some cooling of the fluid in the stem will occur as a result of this contact, however, there generally will be insufficient change in fluid pressure in the stem to allow the pressure sensitive appliance to move to effect valve opening. As the liquid level rises over the insulated portion it will contact more and more of the uninsulated stem portion resulting in significant fluid cooling. As a result, the fluid pressure decreases substantially—indeed in some instances, depending upon the identities of the liquid and fluid, the fluid may condense. This sharp drop in pressure allows for dominance of the ambient atmospheric pressure in the first chamber which causes the pressure sensitive appliance to move so that the valve is opened. With opening, the second vessel can now vent to the ambient atmosphere and the transfer driving force, i.e. the head pressure, is lost. As the liquid in the first vessel is used or is lost to venting, the first vessel liquid level recedes again below the insulated portion of the stem. The fluid in the stem is no longer cooled and heat from the ambient atmosphere, which is in contact with that portion of the stem which is exterior of the first vessel, warms the fluid so that it obtains a pressure greater than the ambient atmospheric pressure in the first chamber thereby causing the pressure sensitive appliance to move to effect reactivation of the valve. The head pressure in the second vessel again starts to build to drive the liquid to the first vessel as before described. The cycle is repeated as often as is necessary to insure that the liquid in the first vessel is maintained at or above the predetermined minimum level. To insure sufficient heat in the second vessel for evolution of gas for providing the needed head pressure, it is sometimes desirable to provide a heat leak. A convenient heat leak can be provided by a rod of a highly heat conductive material, e.g. copper, which extends from the interior of the vessel into the ambient atmosphere.

For liquids having a first vessel temperature higher than that of the ambient atmospheric temperature the second chamber and stem are filled with a selected fluid to a pressure sufficient to move the pressure sensitive appliance towards the first chamber so that the valve will allow gas communication via the conduit between the second vessel and the first chamber. The device is then located so that the lowermost insulated portion of the stem essentially marks the minimum liquid level desired. With gas communication opened between the second vessel and the first chamber, gases evolved in the second vessel will be routed to the first chamber and vented. As the liquid level in the first vessel drops, the liquid leaves contact with the uninsulated portion of the stem and achieves contact with the insulated portion. Since the stem is no longer in direct contact with the first vessel liquid and has its exterior portion in contact with the cooler ambient atmosphere, the stem fluid is cooled and its pressure falls. Thus, the pressure in the second chamber falls below the pressure in the first chamber and allows the pressure sensitive appliance to move to effect closing of the valve. With gas communication between the second vessel and the first chamber closed, the evolved gase in the second vessel cannot vent via the conduit and first chamber and a head pressure begins to build in the second vessel. When this head pressure becomes sufficient, transfer of liquid from the second vessel to the first vessel will be powered through a liquid transfer conduit connecting the interiors of the two vessels. As the liquid level rises it will contact the uninsulated portion of the stem and heat the fluid therein thereby raising its temperature and pressure. The pressure in the second chamber rises causing the pressure sensitive appliance to move and open the valve thereby reestablishing gas communication between the second vessel and the first chamber. Venting can now occur and the head pressure is lost. Without the head pressure needed, the liquid transfer between the first and second vessel ceases.

As can be appreciated from the foregoing, the device of this invention is passive, i.e. it requires no energy input except for the heat or cooling provided to the stem by the ambient atmosphere. Thus, the device has high reliability since it is not dependent upon electrical power or human input to achieve its purpose. If there is concern that the ambient atmosphere ma have wide fluctuations in temperature, then the stem fluid and the initial stem pressure can be chosen to obviate any dysfunction due to temperature variation.

These and other features of this invention which contribute to satisfaction in use and economy in manufacture will be more fully understood from the following description of a preferred embodiment of the invention when taken in connection with the accompanying drawings in which identical numerals prefer to identical parts and in which.

Figure 1:
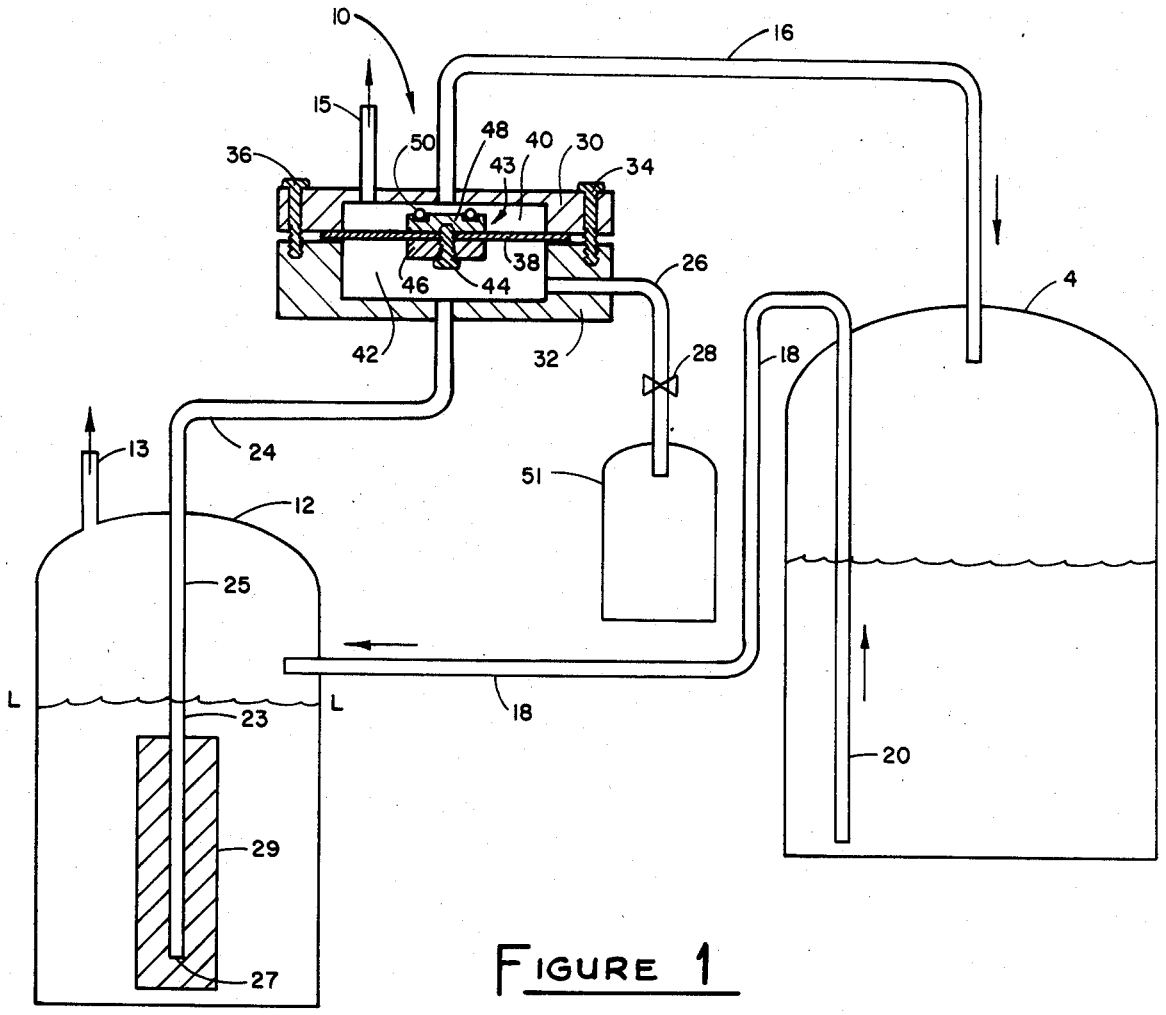
FIG. 1 is a vertical cross-sectional view of a device of this invention and its use with two liquid containing vessels.
Figure 2:
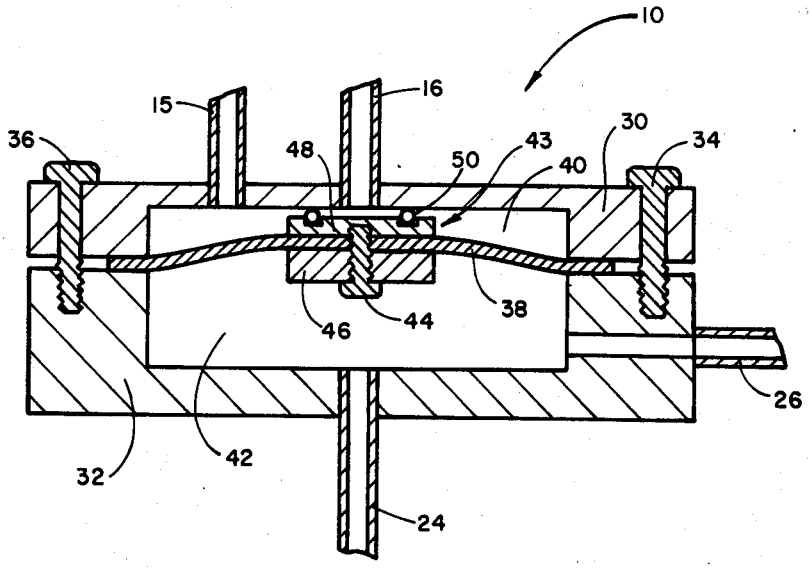
FIG. 2 is an enlarged view of the device shown in FIG. 1.

Referring now to FIGS. 1–2, it can be seen that a device of this invention, generally designated by the numeral 10, is in gas communication by way of conduit 16 to the interior of reservoir vessel 4. Device 10 is especially useful when the liquid in user vessel 12 has a boiling point lower than ambient atmospheric temperature, say a cyrogenic liquid such as liquid nitrogen. Conduit 16 is located at the upper portion of vessel 4 to insure that it will be in receipt of vapors due to the vaporization of the liquid in reservoir vessel 4. Connecting reservoir vessel 4 with user vessel 12 is transfer conduit 18. Conduit 18 has a dip leg portion 20 which extends into the interior of reservoir vessel 4. Dip leg 20 terminates at its lower end at a point well below the minimum liquid level expected in reservoir vessel 4. It is preferred that transfer conduit 18 contain its ingress to user vessel 12 at a point above the maximum liquid level LL which can be expected. Introduction below liquid level LL is possible, however, is not desirable as the liquid in user vessel 12 will back into at least a portion of transfer conduit 18 and be exposed to an ambient atmosphere which may have a temperature above the boiling point of the liquid thereby causing undue vaporization of the liquid in user vessel 12. User vessel 12 has a vent 13 which allows for venting to the ambient atmosphere vapor resulting from the vaporization of liquid contained in that vessel. This vent will, in most circumstances, be open.

Device 10 includes an elongated hollow stem 24. A portion 25 of stem 24 extends into the interior of user vessel 12. Portion 25 extends towards the bottom of user vessel 12 so that a part 23 of portion 25 will be below liquid level LL as is seen in FIG. 1. Stem 24 has closed end 27. Insulation 29 is provided to enclose end 27 and a certain portion of part 23. The lowermost extent of insulation 29 will be determinative of the approximate minimum liquid level which is to be maintained inside of user vessel 12. Generally speaking insulation 29 will extend from about one to about six inches from end 27. For the embodiment shown in the drawings insulation 29 is a styrofoam collar which is in liquid tight relationship with that portion of the stem which it encloses.

Stem 24, is at its other end, in gas communication with lower chamber 42. Lower chamber 42 and oppositely opposed upper chamber 40 are, for the embodiment shown in the drawings, cylindrical in shape. Lower plate 32 and upper plate 30 provide, by way of circular recesses, a portion of the boundaries of lower chamber 42 and upper chamber 40 respectively. As can be seen in the drawings, resilient diaphragm 38 is captured between lower plate 32 and upper plate 30. Thus, lower chamber 42 is defined by the circular recess in lower plate 42 and the under surface of diaphragm 38 while upper chamber 40 is defined by the cylindrical recess in plate 30 and the upper side of diaphragm 38. To locate the two chambers opposite to one another and to insure gas tight sealing of diaphragm 38 between the two chambers, there is provided a plurality of annularly located bolts which affix lower plate 32 to upper plate 30. Bolts 34 and 36 are representative of the bolts utilized.

In gas communication with upper chamber 40 is conduit 16 which, as before described, is in gas communication with reservoir vessel 4.

Lower chamber 42 can be provided with a fluid supply via conduit 26. Conduit 26 is valved by valve 28 and is connected at its distal end with a fluid source and pump 51. Conduit 26 can be disconnected from device 10 after pressured introduction of fluid into lower chamber 42 and stem 24 have been achieved. If such a removal is accomplished, then that portion of conduit 26 which remains with device 10 will have to be sealed to maintain the fluid and its pressure within the just described chamber and stem. The sealing can be accomplished with a valve, 28, or by a permanent seal.

As before mentioned, lower chamber 42 and upper chamber 40 are cylindrical in shape and thus diaphragm 38 is circular in shape. Note further, that conduit 16 achieves gaseous communication with device 10 so that its point of entry into upper chamber 40 is coaxial with the center axis of diaphragm 38. Also coaxially attached to diaphragm 38 is valve member 43. Valve member 43, though simple in construction, has been found to be extremely effective. Valve member 43 comprises valve plate 48 which has on its upper surface an annular recess into which is seated O ring 50. Holding valve plate 48 to diaphragm 38 is bolt 44 which overlies washer 46. Bolt 44 is threaded into a threaded recess through the bottom face of valve plate 48.

In operation device 10 is connected to conduit 16 and is located so that portion 25 of stem 24 is within user vessel 12 in a manner which positions the lower extent of insulation 29 to be in the proximity of the minimum liquid level in user vessel 12 which is desired. Vapors from reservoir vessel 4 pass through conduit 16 to upper chamber 40 and out through vent 15 when diaphragm 38 and valve member 43 are in the position shown in FIG. 1. This position will be referred to as the first position. Lower chamber 42 and stem 24 are then filled with the selected fluid from fluid source and pump 51 to a pressure which causes diaphragm 38 to move towards upper chamber 40 causing O ring 50 to circumvent the entry point of conduit 16 in upper chamber 40. Valve 28 is closed. This position of diaphragm is shown in FIG. 2 and is referred to as the second position. The pressure of the fluid within upper chamber 42 and stem 24 is raised to a value which insures that the abuttment between O ring 50 and the upper surface of upper chamber 40 is gas tight. Valve 28 is then closed or a permanent seal of stem 26 made to secure the obtained pressure. Since the vapor evolving in reservoir vessel 4 is now prevented from venting, a head pressure begins to develop in reservoir vessel 4. When the head pressure becomes sufficient to push the liquid within reservoir vessel up dip tube leg 20 and through conduit 18, transfer of liquid from reservoir vessel 4 and user vessel 12 will occur. The liquid level in user vessel 12 will rise above insulation 29 until the fluid in conduit 24 is chilled sufficiently enough to reduce the fluid pressure in lower chamber 42 to allow diaphragm 38 to return to the first position thereby unsealing conduit 16. With conduit 16 unsealed, venting vapors from the liquid in reservoir vessel 4 can occur through vent 15. When the liquid level in user vessel 12 falls below the approximate lower extent of insulation 29 the fluid within conduit 24 begins to warm, due to the exterior portion of stem 24 being in contact with the warmer ambient atmosphere, until it reobtains a pressure sufficient to move diaphragm 38 to achieve the air tight abuttment of O ring 50 with the upper surface of upper chamber 40. This abuttment will cause, as before described, a close off of conduit 16 thereby allowing for the reestablishment of a head pressure within vessel 4 and the resultant transfer of liquid to user vessel 12. This cycling will continue to occur in response to changing liquid levels in user vessel 12. The only interruption to the described system will be the ultimate emptying of reservoir vessel 4. For that reason, reservoir vessel 4 is usually of large capacity so that its refilling is infrequent.

Figure 3:
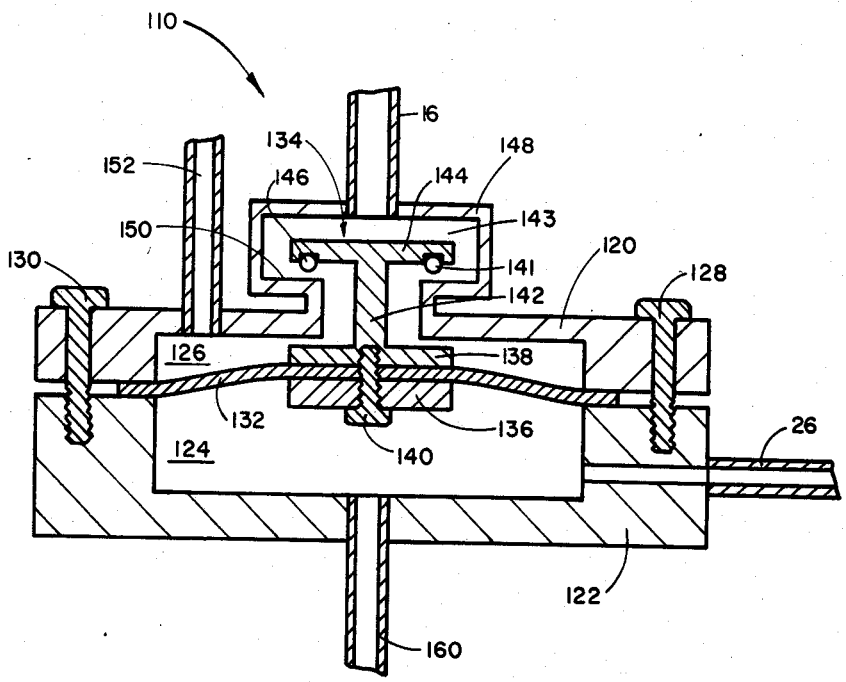
FIG. 3 is an enlarged vertical enlarged view of another embodiment of this invention with the valve in the open position.
Figure 4:
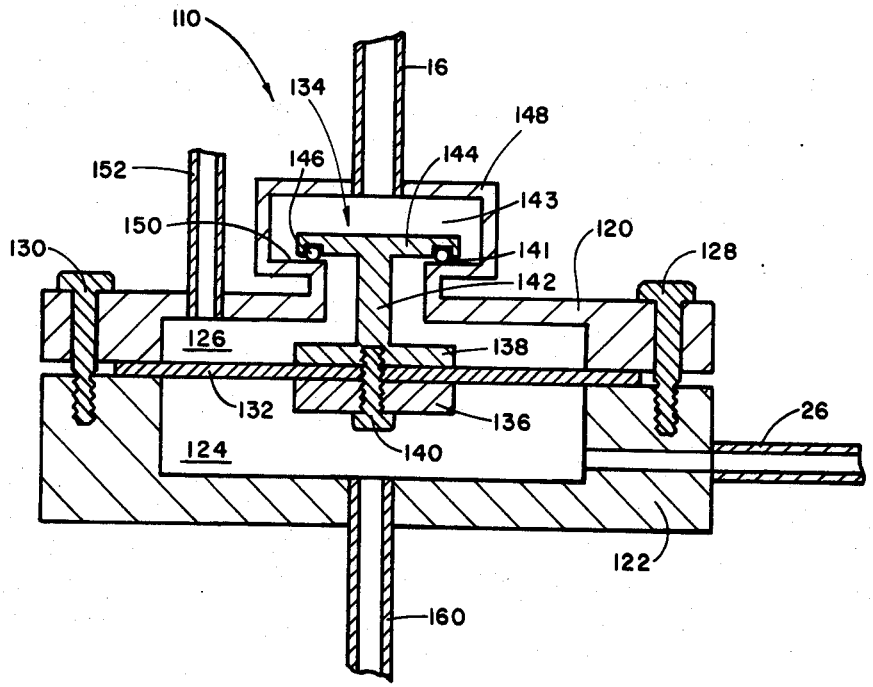
FIG. 4 is an enlarged vertical view of another embodiment of this invention with the valve in the closed position.

Referring now to FIGS. 3 & 4, there can be seen another device of this invention, generally designated by the numeral 110. Device 110 is especially suitable for use when the liquid in user vessel 12 has a temperature sufficiently higher than the ambient atmosphere temperature to provide the necessary heating and cooling of the stem fluid to achieve the stem and second chamber pressures here and before described.

Device 110 is connected to conduit 16 and 26 in the same manner that device 10 is connected as shown in FIG. 1. Reservoir vessel 4 and user vessel 12 are connected interiorly one to the other by transfer conduit 18 also as shown in FIG. 1. Vessel 12 is again provided with vent 13.

Device 110 has an elongated stem 160 which is identical in function and description as stem 24 for device 10. Like stem 24, stem 160 has a closed off end and a contiguous portion which is insulated. The insulation can be provided by a styrofoam collar which is fit to the closed off distal end and contiguous portion in a liquid tight manner.

Stem 160 is, at its proximate end, in gas communication with lower chamber 124. Lower chamber 124 and upper chamber 126 are, for the embodiment shown in FIGS. 3 & 4, cylindrical in shape. Upper chamber 126 and lower chamber 124 are separated one from the other by resilient diaphragm 132. Upper chamber 126 is provided by a cylindrical recess in upper plate 120 while lower chamber 124 is provided by a cylindrical recess in lower plate 122. Upper plate 120 and lower plate 122 are fastened one to the other by way of a plurality of annularly located bolts, two of which are shown in FIGS. 3 & 4 and indicated by the numerals 128 and 130. As can be seen in FIGS. 3 & 4, upper plate 120 and lower plate 122 capture there-between, in a gas tight manner, resilient diaphragm 132. Resilient diaphragm 132 will have an operable circular shape as defined by upper chamber 126 and lower chamber 124. At the center axis of resilient diaphragm 132, there is provided valving structure 134. Valving structure 134 has a lower washer 136 and an upper washer 138 which are held in an opposed relationship on opposite sides of resilient diaphragm 132 by way of bolt 140. Coaxially located and upstanding from washer 138 is valve post 142. Valve post 142 extends within valve chamber 143 which is provided by valve housing 148. Located at the uppermost extent of valve post 142 is valve disk 144 which has about its underside surface annular grove 141 in which is located O-ring 146. Valve housing 148 has an annular bottom wall 150 which is dimensioned so as to underly O-ring 146. In gaseous communication with valve chamber 143 is conduit 16.

Upper chamber 126 is in gaseous communication with vent 152.

Within lower plate 122 there is a gaseous passageway which is in gaseous communication with conduit 26 and can be considered a part thereof. It is to be understood that conduit 26, however, can be removed from lower plate 122 if desired. The function and relationship between device 10 and conduit 26, valve 28 and fluid source and pump 51 is identical to the relationship of the latter to device 110.

In operation device 110 is connected to conduit 16 and is located so that a portion of stem 160 is within user vessel 12. The insulated distal end of stem 160 is positioned within user vessel 12 so that the lowermost extent of the insulated portion approximates the minimum liquid level desired in user vessel 12. Valve 28 in conduit 26 is opened so that fluid source and pump 51 can provided stem fluid within lower chamber 124 and stem 160. The pressure within lower chamber 124 and stem 160 will closely approximate the ambient atmosphere pressure which is in gaseous communication with upper chamber 126 via vent 152. As can be seen in FIG. 4, O-ring 146 is in sealing relationship with annular bottom wall 150. Gaseous communication via conduit 16 between upper chamber 126 and reservoir vessel 4 is thereby sealed off and a head pressure begins to build in reservoir vessel 4. As this head pressure becomes sufficiently large, liquid in reservoir vessel 4 is forced up dip tube portion 20 of transfer conduit 18 so that liquid is transferred from reservoir vessel 4 to user vessel 12. The liquid level in user vessel 12 begins to rise until it extends above the insulated portion of stem 160. Once above the insulated portion, the liquid level in user vessel 12 contacts stem 160 and heats the fluid therewithin. As the fluid is heated its pressure increases thereby increasing the pressure in lower chamber 124. This increase in lower chamber pressure causes resilient diaphragm 132 to deflect upwardly thereby raising O-ring 146 above bottom annular wall 150. The gas seal is broken and gaseous communication is reestablished between reservoir vessel 4 and upper chamber 126. The gas from vessel 4 is then free to escape to the ambient atmosphere via vent 152. As the liquid level in user vessel 12 begins to recede by use or by gaseous evolution the liquid level will once again come in contact with the insulated portion of stem 160. As the liquid level continues to fall the temperature of the fluid within stem 160 begins to cool due to the external portion of stem 160 being in contact with the ambient atmosphere. As the cooling continues the pressure within stem 160 continues to drop thereby lowering the pressure within lower chamber 124 so that resilient diaphragm 132 can achieve the position shown in FIG. 4. In this position, gaseous communication between reservoir vessel 4 and upper chamber 126 is again closed off so that a head pressure can build within reservoir vessel 4 thereby causing the before described transfer of liquid to user vessel 12.

I claim:

1. A device for monitoring, in a first vessel, the liquid level of a liquid having a temperature less than the ambient atmospheric temperature and for effecting the transfer of liquid to said first vessel from a second vessel upon the liquid level in said first vessel reaching a predetermined minimum point, said device comprising:

a. a pressure sensitive means in contact with a gas in a first chamber and a gas in a second chamber, said pressure sensitive means being movable between a first position and a second position, said second position being towards said first chamber when the gaseous pressure in said first chamber is lower than the gaseous pressure existing in said second chamber;

b. a vent for placing said first chamber in gas communication with the ambient atmosphere;

c. a conduit in gas communication with said first chamber and with the interior of said second vessel whereby said first chamber and said second vessel are in gaseous communication with one another;

d. valve means associated with said pressure sensitive means to alternately seal off and leave open said gas communication between said first chamber and said second vessel upon the movement of said pressure sensitive means, respectively, to said second position and to said first position;

e. an elongated hollow stem which, at one of its ends, is in gas communication with said second chamber and which, at its other end, is sealed off, said hollow stem having, (i) said other end and a contiguous portion of said hollow stem located within said first vessel whereby said other end extends to a point adjacent said predetermined minimum liquid level, and (ii) a portion which is exterior of said first vessel and in contact with said ambient atmosphere, f. insulation means for insulating said other end of said stem and a certain part of said contiguous portion, the upper extent of said insulating being below a desired maximum liquid level in said first vessel, and the lower extent of said insulation being adjacent said predetermined minmum liquid level; and g. a fluid within said hollow stem, said fluid providing, (i) a first pressure in said second chamber to allow said pressure sensitive means to move to said first position when said liquid level in said first vessel is at or just adjacent said maximum liquid level, and (ii) a second pressure in said second chamber to allow said pressure sensitive means to move to said second position when said liquid level in said first vessel is at or below said minimum predetermined liquid level.

2. The device of claim 1 wherein said valve means is carried by said pressure sensitive means.

3. The device of claim 1 wherein said pressure sensitive means is a diaphragm.

4. The device of claim 1 wherein said valve means comprises a seal for forming a gas tight relationship with a portion of said first chamber when said seal is brought into abutment with said portion of said first chamber, said gas tight relationship circumventing the point of gas communication between said conduit and said first chamber.

5. The device of claim 1 wherein said pressure sensitive means is a circular diaphragm and wherein said valve means and the point of gas communication between said conduit and said first chamber are located substantially coaxial with the center of said circular diaphragm.

6. The device of claim 5 wherein said said valve means comprises a seal for forming a gas tight relationship with a portion of said first chamber when said seal is brought into abutment with said portion of said first chamber, said gas tight relationship circumventing the point of gas communication between said conduit and said first vessel.

7. The device of claim 6 wherein said valve means is carried by said pressure sensitive means and said certain amount of resilient movement achieves said abutment.

8. The device of claim 1 wherein said stem is a glass tube.

9. The device of claim 1 wherein said insulation means is a jacket of insulating material attached in a liquid tight manner to said other end of said stem and said certain part of said contiguous portion.

10. The device of claim 9 wherein said insulating material is foamed polystyrene.

11. The device of claim 1 wherein said insulation means comproses a vacuum provided by an exterior wall which is in liquid tight relationship with said other end of said stem and said certain part of said contiguous portion and which is outwardly spaced therefrom.

12. The device of claim 1 wherein said fluid is air and said liquid in said first vessel is liquid nitrogen.

13. A device for monitoring, in a first vessel, the liquid level of a liquid having a temperature above that of the ambient atmosphere temperature and for effecting the transfer of liquid to said first vessel from a second vessel upon the liquid level in said first vessel reaching a predetermined minimum point, said device comprising:

a. a pressure sensitive means in contact with a gas in a first chamber and a gas in a second chamber, said pressure sensitive means being movable between a first position and a second position, said second position being towards said first chamber when the gaseous pressure in said first chamber is lower than the gaseous pressure existing in said second chamber;

b. a vent for placing said first chamber in gas communication with the ambient atmosphere;

c. a conduit in gas communication with said first chamber and with the interior of said second vessel whereby said first chamber and said second vessel are in gaseous communication with one another;

d. valve means associated with said pressure sensitive means to alternately seal off and leave open said gas communication between said first chamber and said second vessel upon the movement of said pressure sensitive means, respectively, to said first position and to said second position;

e. an elongated hollow stem which, at one of its ends, is in gas communication with said second chamber and which, at its other end, is sealed off, said hollow stem having, (i) said other end and a contiguous portion of said hollow stem located within said first vessel whereby said other end extends to a point adjacent said predetermined minimum liquid level, and (ii) a portion which is exterior of said first vessel and in contact with said ambient atmosphere, f. insulation means for insulating said other end of said stem and a certain part of said contiguous portion, the upper extent of said insulation being below a desired maximum liquid level in said first vessel, and the lower extent of said insulation being adjacent said predetermined minimum liquid level; and g. a fluid within said hollow stem said fluid providing, (i) a first pressure in said second chamber to allow said pressure sensitive means to move to said second position when said liquid level in said first vessel is at or just adjacent said maximum liquid level, and (ii) a second pressure in said second chamber to allow said pressure sensitive means to move to said first position when said liquid level in said first vessel is at or below said minimum predetermined liquid level.

14. The device of claim 13 wherein said valve means comprises and annular seal and an underlying surface at least coextensive with said seal, said seal forming gas-tight contact with said underlying surface when brought into abuttment therewith.

15. The device of claim 13 wherein said pressure sensitive means is a diaphragm.

16. The device of claim 13 wherein said pressure sensitive means is a circular diaphragm and wherein said valve means and the point of gas communication between said conduit and said first chamber are located substantially coaxial with the center of said circular diaphragm.

17. The device of claim 13 wherein said stem is a glass tube.

18. The device of claim 13 wherein said insulation means is a jacket of insulating material attached in a liquid tight manner to said other end of said stem and said certain part of said contiguous portion.

19. The device of claim 18 wherein said insulating material is foamed polystyrene.

20. The device of claim 13 wherein said insulation means comprises a vacuum provided by an exterior wall which is liquid tight relationship with said other end of said stem and said certain part of said contiguous portion and which is outwardly spaced therefrom.

21. The device of claim 13 wherein said fluid is isopropyl alcohol and said liquid in said first vessel is liquid water.

* * * * *

UNITED STATES PATENT AND TRADEMARK OFFICE

CERTIFICATE OF CORRECTION

PATENT NO. : 4,611,623

DATED : September 16, 1986

INVENTOR(S) : Roy G. Goodrich

It is certified that error appears in the above-identified patent and that said Letters Patent is hereby corrected as shown below:

Column 1, line 29, reads "cyrogenic", should read --cryogenic--.

Column 3, line 41, reads "the the", should read --the--.

Column 4, line 43, reads "cyrogenic", should read --cryogenic--.

Column 5, line 58, reads "gase", should read --gases--.

Column 6, line 12, reads "ma", should read --may--.

Column 6, line 28, reads "enlarged vertical enlarged", should read --enlarged vertical--.

Column 6, line 40, reads "cyrogenic", should read --cryogenic--.

Column 7, line 7, reads "Stem 24,", should read --Stem 24--.

Column 8, line 4, reads "abuttment", should read --abutment--.

Column 8, lines 26 & 27, reads "abuttment", should read --abutment--.

Column 9, line 19, reads "underly", should read --underlie--.

Column 9, line 38, reads "provided", should read --provide--.

Column 10, line 52, reads "insulating", should read --insulation--.

Column 10, line 55, reads "minmum", should read --minimum--.

Column 11, line 19, reads "said said", should read --said--.

UNITED STATES PATENT AND TRADEMARK OFFICE

CERTIFICATE OF CORRECTION

PATENT NO. : 4,611,623

DATED : September 16, 1986

INVENTOR(S) : Roy G. Goodrich

It is certified that error appears in the above-identified patent and that said Letters Patent is hereby corrected as shown below:

Column 11, line 38, reads "comproses", should read --comprises--.

Column 12, line 37, reads "and", should read --an--.

Column 12, line 40, reads "abuttment", should read --abutment--.

Column 12, line 59, reads "is liquid tight", should read --is in liquid tight--.

Signed and Sealed this

Thirtieth Day of December, 1986

*Attest:*

DONALD J. QUIGG

*Attesting Officer*

*Commissioner of Patents and Trademarks*